US005943537A

United States Patent [19]

Ahn

[11] Patent Number: 5,943,537

[45] Date of Patent: Aug. 24, 1999

[54] DEVICE FOR UNIFORMLY REGULATING THE DENSITY OF TONER SUPPLIED TO A DEVELOPING UNIT

[75] Inventor: Byung-Sun Ahn, Suwon-shi, Rep. of Korea

[73] Assignee: SamSung Electronics Co., Ltd., Suwon, Rep. of Korea

[21] Appl. No.: 09/064,823

[22] Filed: Apr. 23, 1998

[30] Foreign Application Priority Data

Apr. 23, 1997 [KR] Rep. of Korea ..... 97-15114

[51] Int. Cl.[6] ..... G03G 15/08

[52] U.S. Cl. ..... 399/254; 399/260; 399/272

[58] Field of Search ..... 399/254, 255, 399/256, 261, 263, 272, 281, 260

[56] References Cited

U.S. PATENT DOCUMENTS 4,458,627 7/1984 Hosono et al. .

5,612,770 3/1997 Bandai et al. ..... 399/254

5,649,197 7/1997 Fujita ..... 399/260

5,722,022 2/1998 Park ..... 399/284

FOREIGN PATENT DOCUMENTS 1-250975 10/1989 Japan .

*Primary Examiner*—Joan Pendegrass

*Attorney, Agent, or Firm*—Robert E. Bushnell, Esq.

[57] ABSTRACT

A developing unit having a device that constantly regulates the toner density supplied to the developing roll by using an elastic member that is installed in a passage between a reservoir chamber and the regulator chamber. The elastic member causes the pressure throughout the developing unit to remain more even despite the force generated by the agitator located in the reservoir chamber. Thus, the density of toner on printed images is more constant, blockages in the developing unit are reduced, and the quality of printed images are improved.

19 Claims, 5 Drawing Sheets

DEVICE FOR UNIFORMLY REGULATING THE DENSITY OF TONER SUPPLIED TO A DEVELOPING UNIT

CLAIM OF PRIORITY

This application makes reference to, incorporates the same herein, and claims all rights accruing thereto under 35 U.S.C. §119 through my patent application entitled *Apparatus for Supplying Toner of Developing Unit and Uniformly Regulating Density Thereof* earlier filed in the Korean Industrial Property Office on the 23rd day of April 1997 and there duly assigned Ser. No. 1997/15114.

BACKGROUND OF THE INVENTION

1. Field of the Invention

The present invention relates to a device for an electrophotographic apparatus and, more specifically, to a device for uniformly regulating the density supplied by the developing unit.

2. Background Art

Supplying a consistently high quality of toner to a photoconductive drum is crucial for the proper operation of an electrophotographic apparatus during the printing process. An electrophotographic apparatus can be either one of a laser printer, an electronic copier, a facsimile machine, or any versatile office machine. The general operation of an electrophotographic apparatus starts with paper being loaded from a supply tray and then transported through to a high pressure transfer roller. The high pressure transfer roller transfers the toner image from the photoconductive drum onto the sheet of paper. Subsequently, the paper is transported to a fixing device that fuses the toner image onto the paper using both heat and pressure rollers.

To prepare the toner image for the high pressure transfer roller, it is necessary to attach toner particles to the latent electrostatic image on the photoconductive drum. The toner particles are applied by the developing unit and transform the latent electrostatic image into a latent toner image.

A toner cartridge charged with a static voltage is contained in the developing unit and supplies toner to the supply roller. The toner is stirred by an agitator that keeps the toner evenly charged and mixed. The electrostatically charged toner is transferred to the supply roller by the rotation of the agitator. The rotation of the supply roller then transfers the toner to a developing roller. The toner deposited on the developing roller is uniformly applied due to a doctor-blade that maintains a constant level of thickness of toner on the developing roller.

A photoconductive drum is charged by a charger roller with a static negative voltage. Then, the photoconductive drum is rotated and exposed to the light from a light emitting device. The parts of the photoconductive drum surface exposed to the light generate an latent electrostatic image. This latent electrostatic image is transformed into a latent toner image when toner particles are attached to the latent electrostatic image by the developing roller. A sheet of paper loaded from a paper tray is fed into the electrophotographic apparatus by a pickup roller. The paper is then transferred to a high pressure transfer roller that presses the paper against the photoconductive drum to transfer the toner image onto the sheet of paper from the drum. Then the paper, and applied toner image, is transported between the heating roller and the pressure roller of a fixing unit to fuse the toner image into the sheet using both heat and pressure.

More specifically, the developing roller is mounted between the photoconductive drum and the toner supply roller. Toner is stirred by the agitator and fed to the developing roller. A doctor-blade contacts the developing roller and controls the thickness of the toner applied to the developing roller. Then, the photoconductive drum rotates and brings the latent electrostatic image into contact with the layer of toner formed on the developing roller, thus developing a latent toner image.

However, since the volume of the toner regulator is fixed, and toner is separately distributed in a flexible area and a stagnant area, it is difficult to uniformly mix the toner. Therefore, it is also difficult to appropriately charge the toner. Moreover, since there is no additional device for controlling the toner supplied to the regulator, if the toner is excessively supplied through the supply channel by the agitator, a background may occur on the image bearing document. Furthermore, the excessive supply of the toner leads to an increase in the pressure of the regulator and thus an increase in internal volume density. Then the toner becomes stagnant and is blocked. Only the uncharged toner or carrier deviate from the doctor blade, thereby deteriorating density and worsening development. Furthermore, a partial blocking at the supply channel is the cause of a white band.

Techniques to improve the development process are shown, for example, in U.S. Pat. No. 5,649,197 to Fujita entitled *Development Apparatus Including Nonmagnetic Single-Component Developer Guide Member*, U.S. Pat. No. 4,458,627 to Hosono entitled *Developing Apparatus for Electrostatic Image*, and U.S. Pat. No. 5,722,022 to Park entitled *Device for Regulating Thickness of Toner Layer on Developing Roller.* Developing units found in the contemporary art do not have a device that allows the toner pressure in the area of the developing roller to stay constant despite the forces generated by the rotation of the agitators in the toner reservoir, that is simple to make, that has an elastic structure, that prevents a toner block from developing in the developer unit, that aids in maintaining uniformly charged toner in the developing roller area, and that improves the quality of images produced by an electrophotographic apparatus.

I believe it may be possible to improve on the prior art by providing a developing unit that has a device that uniformly regulates toner density on the developer roller while maintaining constant pressure in the developing unit despite the rotation of agitators, and that aids in maintaining uniformly charged toner in the developer roller area.

SUMMARY OF THE INVENTION

Accordingly, it is an object of the present invention to provide an improved developing unit.

It is another object to provide a device for a developing unit that uniformly regulates toner density in the developer roller area of the developing unit.

It is still another object to provide a device for a developing unit that aids in maintaining a uniformly charged toner in the developer roller area.

It is yet another object to provide a device for a developing unit that aids in preventing a toner blockage from developing in the developing unit.

It is still yet another object to provide a device for a developing unit that is simple to manufacture.

It is a further object to provide a device for a developing unit that improves the quality of images produced by an electrophotographic apparatus.

These and other objects may be achieved by providing a developing unit having a device that constantly regulates the toner density supplied to the developing roll by using an elastic member that is installed in a passage between a reservoir chamber and the regulator chamber. The elastic member causes the pressure throughout the developing unit to remain more even despite the force generated by the agitator located in the reservoir chamber. Thus, the density of toner on printed images is more constant and printed images are improved.

A second embodiment of the invention replaces the mounted elastic member with a pivotally mounted rib that is able to pivot freely in response to forces generated by the rotation of the agitator in the reservoir chamber. The rotation of the pivot can be limited by protrusions located on both side of the rib. The rib constantly vibrates in response to the rotation of the agitator in the reservoir chamber and constantly regulates the density of toner in a developing unit of an electrophotographic apparatus.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE DRAWINGS

Figure 1:
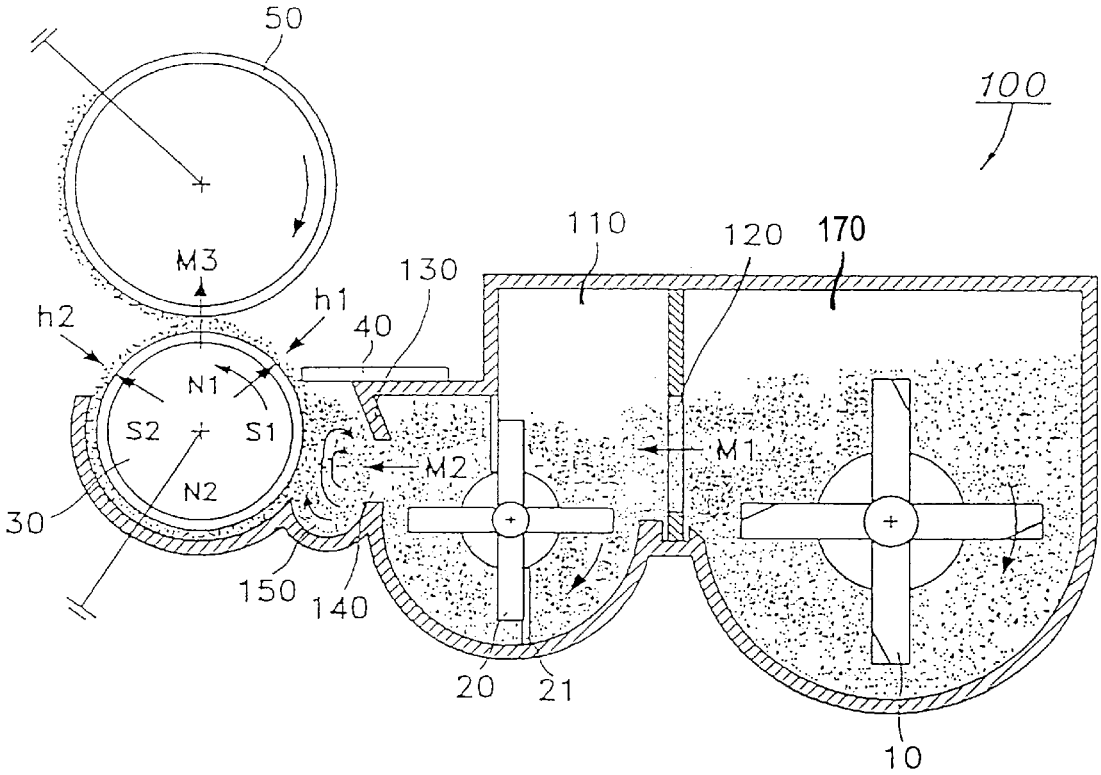
(RELATED ART) FIG. 1
FIG. 1 illustrates a developing unit.

Turning now to the drawings, FIG. 1 illustrates a developing unit. Toner is supplied from first and second reservoir chambers 170 and 110 of developing unit 100 to photosensitive drum 50 via first and second agitators 10 and 20 and developing roller 30. Doctor blade 40 uniformly regulates the thickness of the layer of toner applied to developing roller 30. Developing roller is mounted on developing roller support section 160. Fins 21 are installed on second agitator 20 to facilitate the propulsion of toner. If toner M1 is supplied to second agitator 20 through first passage 120 by the rotation of first agitator 10, second agitator 20 supplies toner M2 to regulator chamber 150 through second passage 140 by forces generated by the rotation of the second agitator. Friction and circulation between the toner and carrier supplied to regulator chamber 150 cause the toner to be charged. The height of toner on developing roller 30 is regulated by doctor blade 40. The toner on developing roller 30 is charged with a negative electric charge and is applied to a latent electrostatic image on photosensitive drum 50. Then, toner is transferred to paper by a high positive voltage applied by a transfer unit (not shown) and the toner image is fixed to the paper by high pressure and high temperature applied from a fixing unit.

Figure 2:
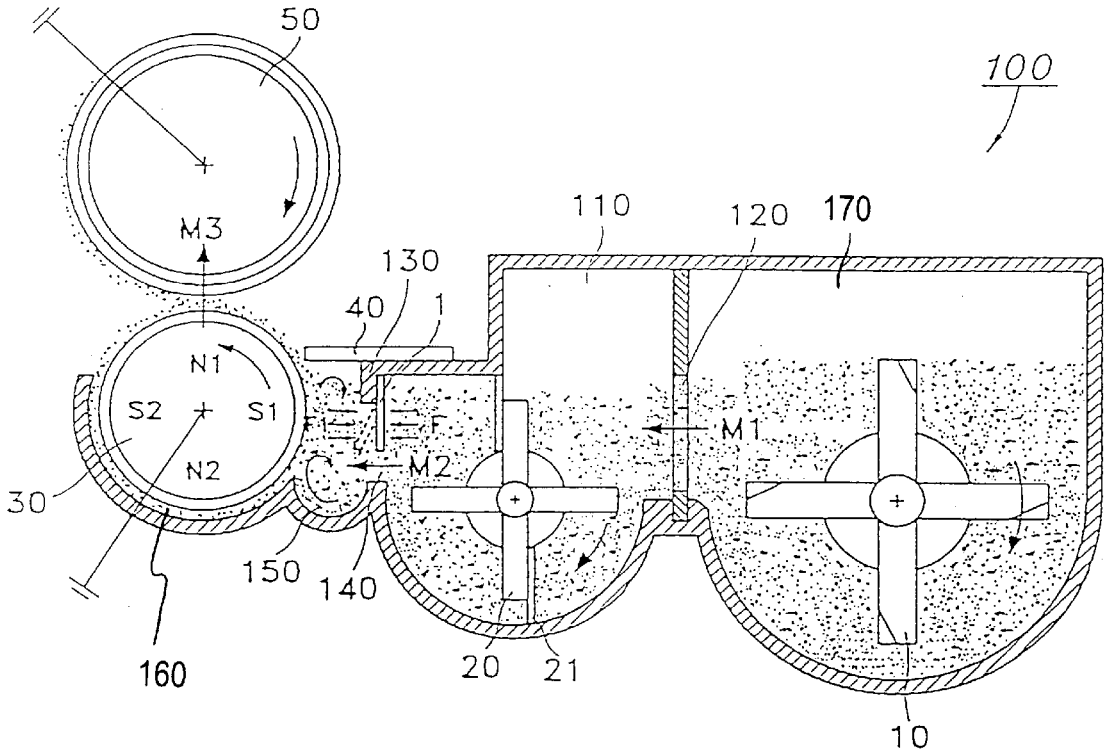
FIG. 2 illustrates a first embodiment of a developing unit as constructed according to the principles of the present invention.
Figure 4:
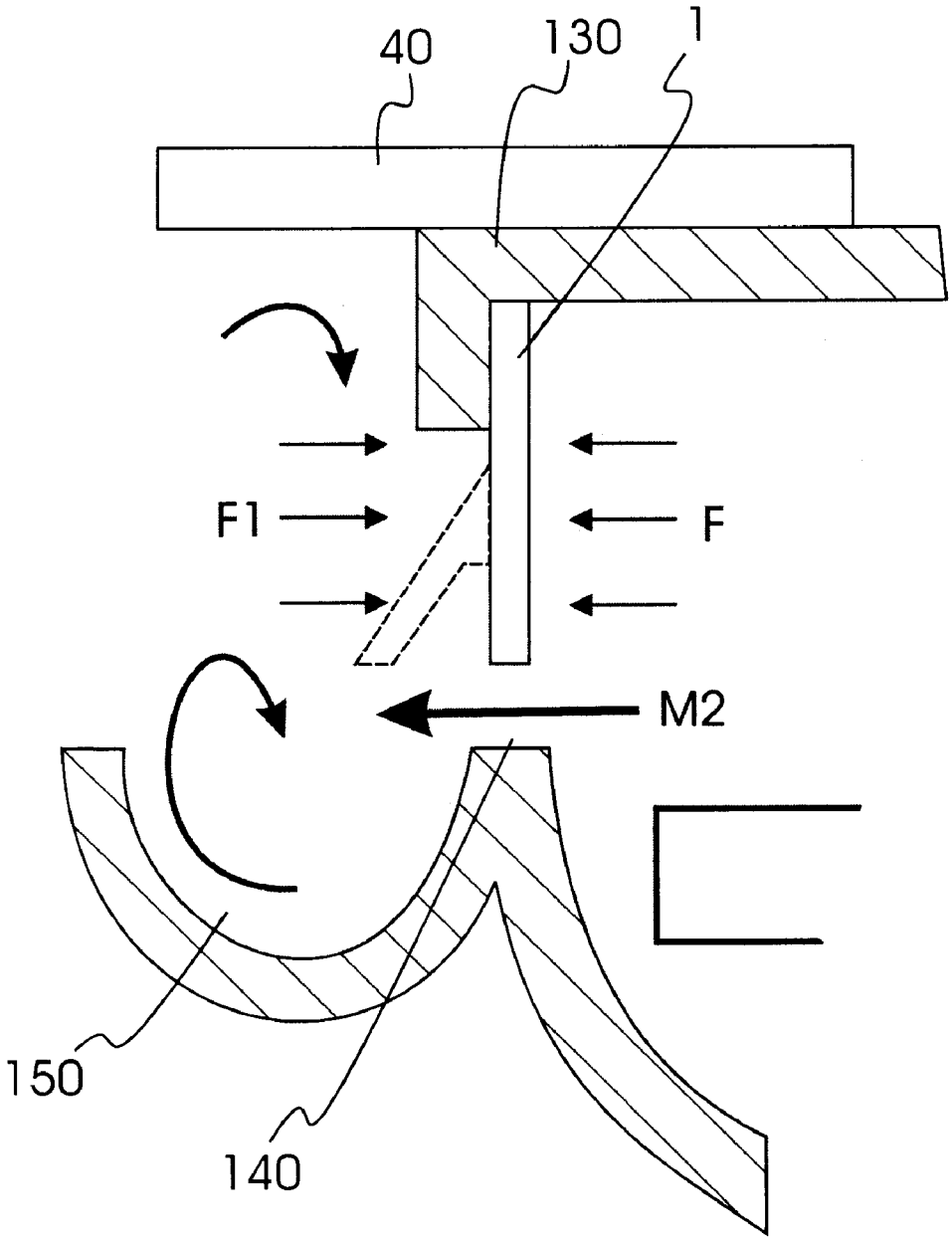
FIG. 4 illustrates the connection between the chassis and the elastic member in the developing unit of FIG. 2.

FIG. 2 illustrates a developing unit as construct according to the principles of the present invention. Developing unit 100 has elastic member 1 extending from a lower portion of ridge 130 of second passage 140 between regulator chamber 150 and second agitator 20, as also shown in FIG. 4. Ridge 130 would normally be used to block toner without additional components, as shown in FIG. 1. Elastic member 1 is preferably a flexible film having elastic force and flexibility. Elastic member 1 controls the toner supplied to regulator chamber 150 and prevents a blocking of the toner in second passage 140. Polyethylene terephthalate is suitable for use as the elastic member 1. The length of a free end of elastic member 1 ranges from 1 millimeter to 5 millimeters and the thickness of elastic member 1 ranges from 50 micrometers to 200 micrometers.

Second reservoir chamber 110 and regulator chamber 150 are separated by ridge 130 that extends downward. Regulator chamber 150 provides a space between developing roller 30 and second passage 140. In this space, the toner and a developing roller are charged through the circulating toner contacting the roller. Additionally, this space is a storage place for toner. As known to one skilled in the art, developing roller 30 consists of a magnetic roll having the constant number of poles and magnetic force. Developing roller 30 conveys the toner during rotation to the photosensitive drum.

First agitator 10 rotates to supply toner to the second agitator 20 through first passage 120. Then, the toner is supplied to regulator chamber 150 through second passage 140 by the rotation of second agitator 20. The toner is more effectively propelled due to the use of fin 21 that is fixed to second agitator 20.

If excessive toner is supplied to regulator chamber 150, elastic member 1 is subject to elastic deformation, as indicated by the dotted line in FIG. 4. Afterwards, elastic member 1 is returned to the member's original position by restorative force F. This prevents toner from being excessively supplied. Elastic member 1 controls the amount of toner conveyed by preventing an increase in the internal pressure within regulator chamber 150. Thus, the amount of the toner supplied by the agitator maintained at a constant level despite the pressure fluctuations generated by the rotation of second agitator 20.

In more detail, if toner is excessively supplied by second agitator 20, elastic member 1 is moved from the original position to the position denoted by the dotted line. A developer brush constantly picks up the toner and generates a forced inflow of toner twice per rotation of second agitator 20. This causes elastic member 1 to vibrate, depending on the pressures generated by the propelled toner, by deforming and returning to the original position. Thus, blocking stagnant toner supplied through second passage 140 is released and a constant amount of toner is supplied to regulator chamber 150.

Regulator chamber 150 uniformly charges the toner picked up from second reservoir chamber 110, to improve picture quality and eliminate background. Elastic member 1 prevents the developing roller in developer roller supporting section 160 from being supplied different densities of toner.

Elastic member 1 controls the supply of the toner and allows the toner to be supplied to a pickup brush area of developing roller 30 by its elastic force and flexibility. Since the regulator uniformly charges the toner, the background, deterioration in density, and poor uniformity can be prevented. Furthermore, since blocked toner in the second passage is released by the continuous vibration of the elastic member, uniform density is maintained. If the consumption of the toner increases due to black printing, the film is moved to the position indicated by the dotted line so that the toner may be continuously supplied. If an image requiring low density is printed, elastic member 1 is moved to the original position.

Figure 3:
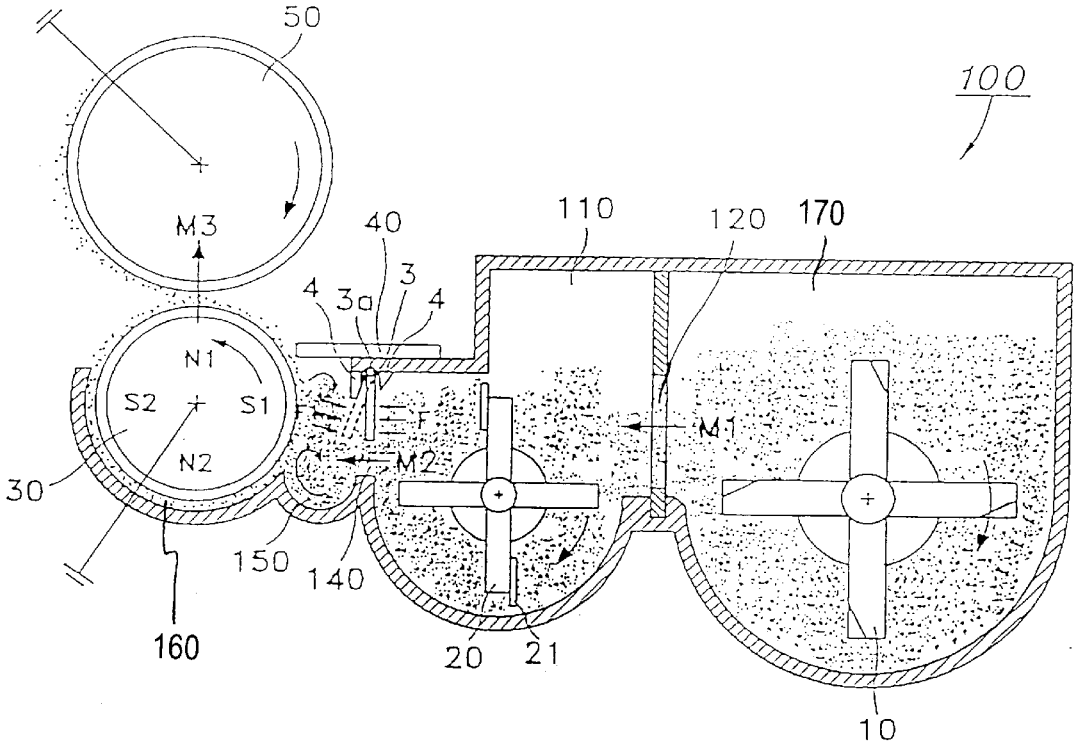
FIG. 3 illustrates a second embodiment of a developing unit as constructed according to the principles of the sent invention.
Figure 5:
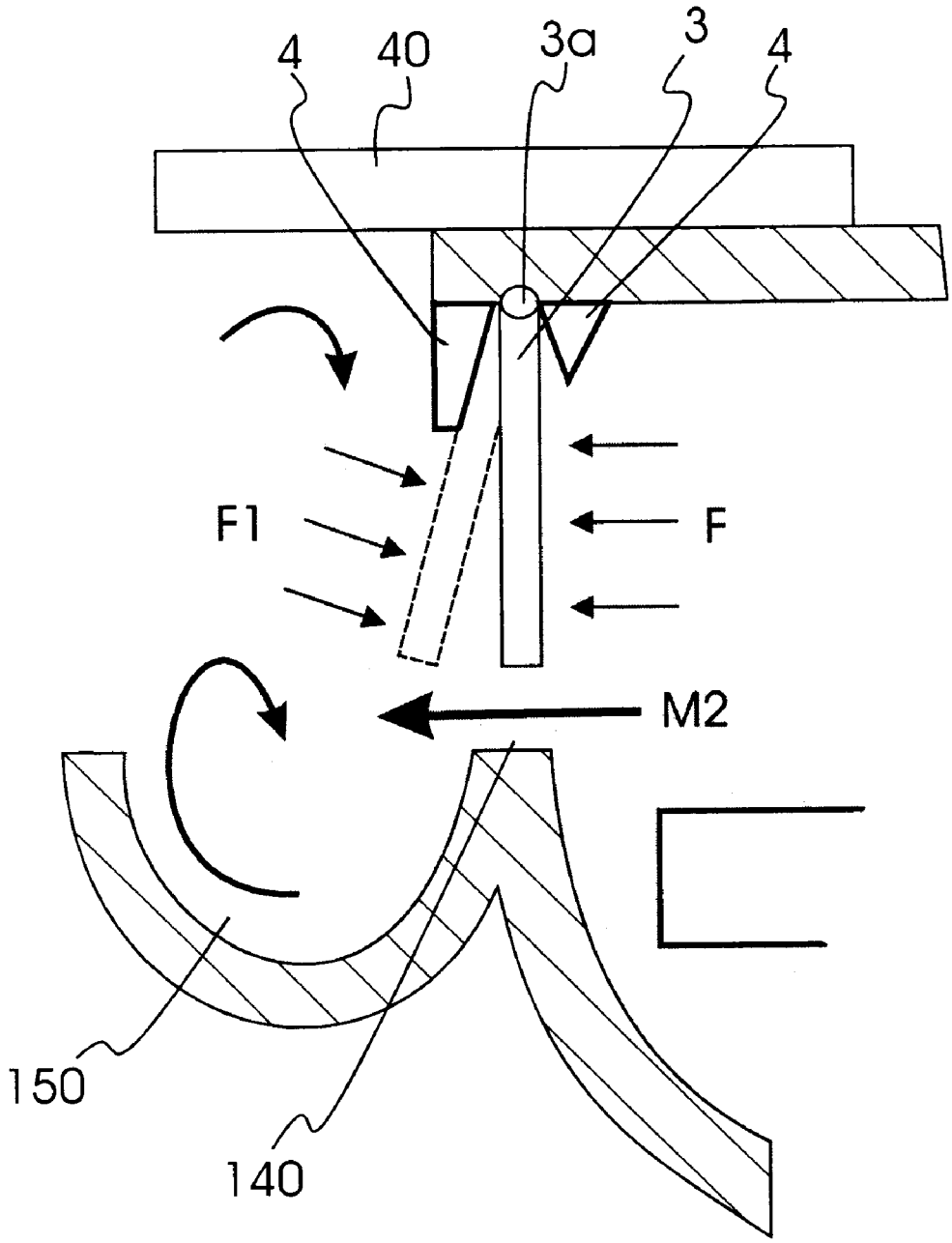
FIG. 5 illustrates the connection between the chassis and the pivotally mounted rib in the developing unit of FIG. 3.

FIGS. 3 and 5 show a pivotally mounted rib that is used instead to regulate toner flow in developing unit 100 instead of elastic member 1. Rib 3 is pivotally mounted on hinge 3*a*. Rib 3 controls the amount of the toner supplied to regulator chamber 150 and prevents the blocking of the toner in second passage 140. In regulator chamber 150, the toner and the developing roller are charged. The developing roller is supplied with toner and then rotated by doctor blade 40. Regulator chamber 150 charges the toner through circulation of the toner, the movement of developing roller 30, and the magnetic force of the magnetic roll of the developing roller 30. The volume of toner that can be held by regulator chamber 150 varies depending on the position of rib 3. Toner M1 is supplied through first passage 120 by the rotation of first agitator 10, and toner M2 is supplied to regulator chamber 150 through second passage 140 by the rotation of second agitator 20.

When printing an image of high toner density, the amount of returning toner on developing roller 30 is much smaller than the amount of toner initially conveyed by the developing roller, thus the volume of regulator chamber 150 is reduced. The toner fixed to the developing roller 30 between N2 and S1 is picked up or supplied to regulator chamber 150 and the circulation of toner towards doctor blade 40 becomes uniform. Thus, the toner is uniformly charged.

If the toner supplied to regulator chamber 150 increases, rib 3 is moved from the position denoted by a dotted line to the original position. If a partial increase in toner image density is requested, regulating rib 3 is continuously vibrated by supply force F from second agitator 20 and repelling force F1 of regulator chamber 150. Moreover, regulating rib 3 automatically moves toward a position that balances the forces being exerted by the toner on both regulator chamber 150 and second reservoir chamber 110. Rib 3 installed in second passage 140 has protrusions 4 located on both sides to limit the range of rotation through which rib 3 can move.

Toner is uniformly charged by changing the volume of regulator chamber 150. The supplied amount of the toner can be changed by the vibration or movement of regulating rib 3. Since the stagnant portion of the space provided in regulator chamber 150 is changed, the circulation of the toner is improved. If the toner is transported, only the toner in the space and on developing roller 30 is transported to photosensitive drum 50.

Although this preferred embodiment of the present invention has been disclosed for illustrative purposes, those skilled in the art will appreciate that various modifications, additions and substitutions are possible, without departing from the scope and spirit of the invention as disclosed in the accompanying claims. It is also possible that other benefits or uses of the currently disclosed invention will become apparent over time.

What is claimed is:

1. A developing unit, comprising:

a chassis containing toner, said chassis comprising;

a first reservoir chamber;

a second reservoir chamber positioned adjacent to said first reservoir chamber;

a first passage connecting said first reservoir chamber to said second reservoir chamber;

a regulator chamber positioned adjacent to said second reservoir chamber;

a second passage connecting said second reservoir chamber to said regulator chamber; and a developer roller supporting section positioned adjacent to said regulator chamber;

a first agitator mounted in said first reservoir chamber;

a second agitator mounted in said second reservoir chamber;

a plurality of fins attached to said second agitator;

a developing roller mounted in said developer roller supporting section;

a doctor blade attached to said chassis substantially parallel to said second passage; and an elastic member mounted in said second passage while projecting an end of said elastic member into said second passage to regulate the flow of toner by moving in response to the flow of toner in said developing unit.

2. The developing unit of claim 1, further comprised of said elastic member being a flexible film.

3. The developing unit of claim 2, further comprised of said flexible film being manufactured of polyethylene terephthalate.

4. The developing unit of claim 2, further comprised of said flexible film having a free end with a length in the range of approximately between 1 millimeter to 5 millimeters and said flexible film having a thickness in the range of approximately between 50 micrometers to 200 micrometers.

5. The developing unit of claim 1, further comprising a ridge protruding from one end of said second passage perpendicularly to said second passage.

6. The developing unit of claim 5, further comprised of said elastic member being attached to said ridge.

7. The developing unit of claim 1, further comprised of said elastic member being pivotally attached to said second passage with an equilibrium position extending substantially perpendicularly across said second passage and vibrating in response to the motion of said second agitator.

8. A developing unit, comprising:

a chassis containing a toner, said chassis comprising;

a first reservoir chamber;

a second reservoir chamber positioned adjacent to said first reservoir chamber;

a first passage connecting said first reservoir chamber to said second reservoir chamber;

a regulator chamber positioned adjacent to said second reservoir chamber;

a second passage connecting said second reservoir chamber to said regulator chamber; and a developer roller supporting section positioned adjacent to said regulator chamber;

a first agitator mounted in said first reservoir chamber;

a second agitator mounted in said second reservoir chamber;

a plurality of fins attached to said second agitator;

a developing roller mounted in said developer roller supporting section;

a doctor blade attached to said chassis substantially parallel to said second passage;

an rib pivotally mounted in said second passage with an equilibrium position extending substantially perpendicularly across said second passage and vibrating in response to the motion of said second agitator;

two protrusions attached to said chasis on opposing sides of said rib to limit the rotation of said rib; and an end of said rib projecting into said second passage to regulate the flow of toner by moving in response to the flow of toner in said developing unit.

9. A developing unit, comprising:

a chassis containing a toner, said chassis comprising;

a reservoir chamber positioned adjacent to a first reservoir chamber;

a regulator chamber positioned adjacent to said reservoir chamber; and a passage connecting said reservoir chamber to said regulator chamber;

an agitator mounted in said reservoir chamber; and a flexible film mounted in said passage with a distal end extending substantially perpendicularly across a second passage and regulating the flow of toner by moving in response to the flow of toner in said developing unit, said flexible film being formed of polyethylene terephthalate and having a free end with a length in the range of between approximately 1 millimeter to 5 millimeters and said flexible film having a thickness in the range of 50 micrometers to 200 micrometers.

10. The developing unit of claim 9, further comprising a second reservoir chamber located adjacent to said reservoir chamber.

11. The developing unit of claim 10, further comprising:

a second passage connecting said reservoir chamber to said second reservoir chamber;

a second agitator mounted in said second reservoir chamber;

a plurality of fins attached to said agitator;

a developer roller supporting section positioned adjacent to said regulator chamber;

a developing roller mounted in said developer roller supporting section; and a doctor blade attached to said chassis substantially parallel to said passage.

12. The developing unit of claim 9, further comprising a ridge protruding from one end of said second passage and protruding perpendicularly to said second passage.

13. The developing unit of claim 12, further comprised of said flexible film being attached to said ridge.

14. The developing unit of claim 9, further comprised of said flexible film being pivotally attached to said second passage with an equilibrium position extending substantially perpendicularly across said second passage and vibrating in response to the motion of said second agitator.

15. A developing unit, comprising:

a chassis containing a toner, said chassis comprising;

a reservoir chamber;

a regulator chamber positioned adjacent to said reservoir chamber; and a passage connecting said reservoir chamber to said regulator chamber;

an agitator mounted in said reservoir chamber; and a rib pivotally mounted in said passage and having an equilibrium position substantially perpendicular to said passage, said rib vibrating in response to the motion of said agitator in said reservoir chamber, said rib regulating the flow of toner by moving in response to the flow of toner in said developing unit.

16. The developing unit of claim 15, further comprising two protrusions attached to said chasis on opposing sides of said rib to limit the rotation of said rib.

17. The developing unit of claim 16, further comprising a second reservoir chamber positioned adjacent to said reservoir chamber.

18. The developing unit of claim 17, further comprising:

a second passage connecting said reservoir chamber to said second reservoir chamber;

a second agitator mounted in said second reservoir chamber; and a plurality of fins attached to said agitator.

19. The developing unit of claim 18, further comprising:

a developer roller supporting section positioned adjacent to said regulator chamber;

a developing roller mounted in said developer roller supporting section; and a doctor blade attached to said chassis substantially parallel to said passage.

* * * * *